United States Patent [19]

Prunier

[11] 4,085,553

[45] Apr. 25, 1978

[54] LENS SURFACING ADAPTOR

[75] Inventor: Louis Prunier, Oxford, Mass.

[73] Assignee: American Optical Corporation, Southbridge, Mass.

[21] Appl. No.: 779,655

[22] Filed: Mar. 21, 1977

[51] Int. Cl.[2] ..... B24B 13/00

[52] U.S. Cl. ..... 51/216 LP; 74/813 R

[58] Field of Search ..... 51/216 LP, 217 L; 403/107; 74/813 R

[56] References Cited

U.S. PATENT DOCUMENTS

| | | | |
|---|---|---|---|
| 1,202,013 | 10/1916 | Ainsley | 51/217 L |
| 1,404,828 | 1/1922 | Baum | 403/107 X |
| 2,748,548 | 6/1956 | Hilsinger | 51/216 L |
| 3,177,740 | 4/1965 | Firestone | 74/81 B X |
| 3,460,928 | 8/1969 | Casko | 51/216 LP |
| 3,846,912 | 11/1974 | Newbould | 74/813 R |

*Primary Examiner*—Harold D. Whitehead

*Attorney, Agent, or Firm*—Jeremiah J. Duggan; Howard R. Berkenstock, Jr.

[57] ABSTRACT

Ophthalmic lens surfacing with preformed tools (laps) requires the traditional blocking and pressing of a lens against the tool with force applied to the block. Lens blocks being thereby geometrically decentered in many of larger diameter lenses causing force applied to the block to be unevenly distributed over the lens-tool surfacing interface. This being detrimental to final lens surface shape and finish is avoided according to the present invention by the provision of a universally adjustable lens block adaptor designed to receive and distribute the surfacing pressure uniformly over the lens-tool interface.

10 Claims, 10 Drawing Figures

LENS SURFACING ADAPTOR

BACKGROUND OF THE INVENTION

1. Field of the Invention

This invention relates to ophthalmic lens surfacing tools with particular reference to means for adapting blocked lenses to lens surfacing machinery.

2. Description of the Prior Art

Blocked ophthalmic lenses having semifinished surfaces requiring final precision grinding and polishing are traditionally pressed against preformed tools (laps) and oscillated thereover with force applied to the block. The block being customarily aligned with the optical center of the lens and thereby geometrically decentered in cases of larger lens sizes results in forces applied to the block being unevenly distributed over the lens-tool surfacing interface. This in turn causes uneven grinding and polishing of the lens surface. Uneven pressure in grinding, tends to introduce prismatic error into the ophthalmic correction desired to be provided by the finished lens while uneven pressure during polishing produces areas of incomplete finishing where least pressure is applied and/or requires prolonged polishing cycles. Incomplete polishing produces what is often referred to as "gray" areas rendering the lenses consumer rejectable while lengthy polishing times uneconomically tie up both equipment and manpower.

The problem being identifiable as a need to apply pressure uniformly over a lens-tool surfacing interface has heretofore lacked a practical solution. For example, deblocking after lens surface milling or generating and reblocking on geometrical center for fine grinding (lapping) and polishing would be unduly time consuming and uneconomical.

Lens blocking methods and apparatuses such as are disclosed in U.S. Pat. Nos. 2,603,922 and 2,748,548 for example suggest that more than one recess may be provided in a lens block for reception of block holding means during lens grinding. These references, however, fail to offer or suggest the universality needed to accurately geometrically center applied grinding or polishing forces in decentered blocking situations.

Accordingly, it is a principle object of the present invention to accomplish universal geometrical centering and distribution of grinding and polishing forces uniformly over lens-tool surfacing interfaces in all situations of lens block decentering normally encountered in the art.

To this end, it is an object of the invention to provide universally adjustable lens block adaptor means designed to receive and direct lens surfacing pressure geometrically centrally and uniformly over a lens-tool surfacing interface.

Other objects and advantages of the invention will become apparent from the following description.

SUMMARY OF THE INVENTION

The foregoing objects and their correlaries are accomplished by the provision of a universally adjustable lens block adaptor designed to receive and distribute a lens surfacing pressure uniformly over a lens-tool interface in grinding and polishing operations performed with preformed tools more particularly of the type known and referred to in the art as laps.

In the usual fashion of placing a surface of a lens to be fine ground and polished against a preformed lap for oscillation over the surface of the lap during application of a grinding or polishing medium thereto, the lens has thereon the block originally used to rough grind, i.e. mill or generate, the surface to be finally worked according to the present invention. As is customary, such a block is centered with the intended optical center of the ophthalmic lens to be produced from the blank and as in most cases encountered in present day practice, optical centering of the block results in its being geometrically decentered. Accordingly, application of a grinding and polishing force to such a decentered block results in uneven distribution of the applied force over the lens-tool surfacing interface. This in turn causes uneven grinding and polishing during the final lens surfacing operation. In fine grinding, a resulting greater removal of lens material beneath the geometrically decentered block than diametrically oppositely thereof introduces prismatic error into the ophthalmic correction intended to be provided by the finished lens. In similar fashion, an uneven pressure at a lens-tool surfacing interface during final polishing tends to produce incompletely finished areas wherever least pressure is applied and/or require unduly prolonged polishing times, i.e. of sufficient duration to polish out these areas under least pressure so as to prevent occurrence of what is referred to in the art as "gray" areas.

The universally adjustable adaptor of the present invention comprises a first member designed to be readily detachably applied to the customary lens block and an overlying second member which may be selectively adjusted in all lateral directions over the first member to a point where it becomes centered with the geometrical center of the lens. With this adaptor, a force applied centrally to its second member will be directed geometrically centrally against the lens blank and evenly distributed over the lens-tool surfacing interface. Adjoining faces of the first and second members are specially knurled or otherwise provided with interlocking protrusions and recesses respectively to prevent their relative lateral and rotational displacement following the aforesaid adjustment and application of a grinding and/or polishing force thereagainst.

Details of the invention will become more readily apparent from the following description when taken in conjunction with the accompanying drawings.

IN THE DRAWINGS

DESCRIPTION OF THE PREFERRED EMBODIMENTS

Figure 1:
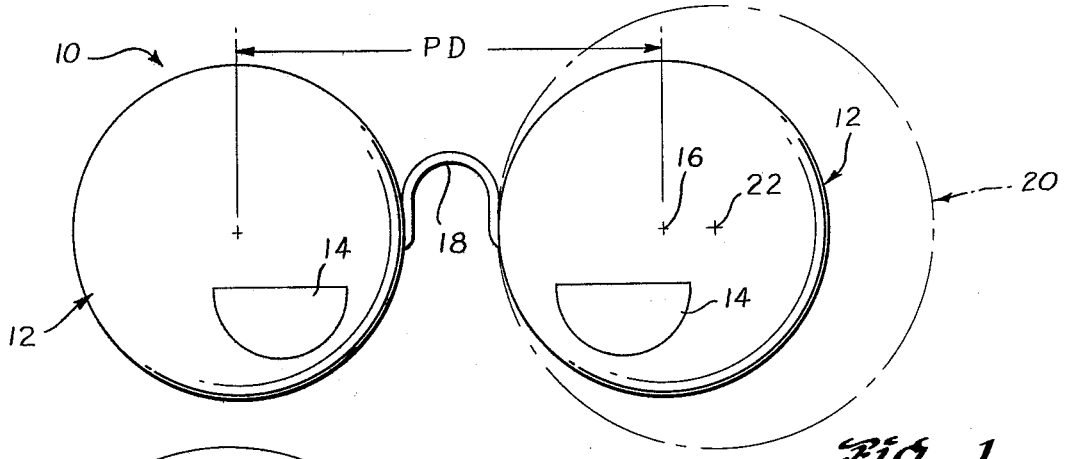
Fig. 1 (PRIOR ART)
FIG. 1 is a diagrammatic illustration, in front elevation, of a spectacles frame which will be used hereinafter to demonstrate the purpose and accomplishment of the present invention.

Referring more particularly to FIG. 1, there is diagrammatically illustrated in full lines a pair of spectacles 10 including ophthalmic lenses 12 which for purposes of illustration only have been shown as incorporating near vision segments 14.

In order to illustrate as simply as possible situations in the art which create the particular difficulties in finishing ophthalmic lens surfaces which are overcome by the present invention, lenses 12 have been depicted as circular and as having geometrical centers 16 which are coincident with their respective optical centers and spaced apart a distance PD equal to the intended wearers interpupillary distance. While this would be the ideal situation for fitting ophthalmic spectacles to a patient, it should be understood that it is extremely rare for ophthalmic lens finishing and spectacles fitting to bring the geometrical centers of lenses into coincidence with their optical centers and at the same time have optical centers spaced a distance apart exactly equal to the patients interpupillary distance, i.e. after fitting with bridge 18 over the nose of a patient.

More usual is the situation where a lens geometrical center is displaced from its optical center, the optical center being the point on a lens intended to be supported directly in front of or coaxially with a patients eye and where meridians of cylinder and spherical correction intersect. Optical center decentration which is the more usual and nearly always occurring situation in present day ophthalmic optics is demonstrated in FIG. 1 by dot-dash outline which represents a lens 20 of greater diametral dimension than either of lenses 12.

It can be seen that for a practitioner to fit a patient with an interpupillary distance PD using bridge 18, it would be required that the optical center of lens 20 be coincident with center 16 of lens 12 which is to be replaced by lens 20. This accordingly displaces the optical center of lens 20 from its geometrical center 22.

Since, as pointed out above, it is essential that prescriptive surface curvatures to be provided on a lens such as lens 20 be centered with the intended optical center of the lens (i.e. the apex of a spherical surface to be produced or the intersection of spherical and cylinder meridians of a toric surface to be produced) it becomes necessary to block the lens on optical center. In this respect, lens 20 is shown in full line illustration in FIG. 2, as having block 24 concentric with optical center 26. Lens 20 has geometrical center 22.

Since it is immaterial to the present invention as to how block 24 may be formed and/or applied to lens 20 and the various techniques usually used such as casting a block directly in place with low temperatures melting alloys or cementing preformed blocks thereinplace, details of blocking procedures per se will not be discussed. Those interested in such details however may refer to U.S. Pat. Nos. 2,580,507; 2,253,954 and 3,195,197; 3,118,198.

It is to be understood that use of the term "lens" herein is intended to include the blank of either glass or plastic from which the finished ophthalmic lens product is formed.

Figure 2:
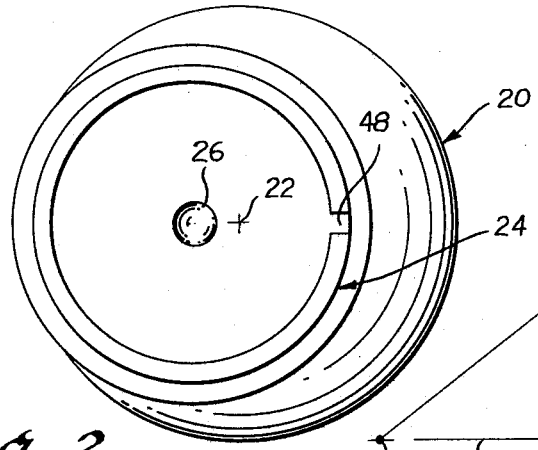
Fig. 2 (PRIOR ART)
FIG. 2 is a top plan view of a blocked lens blank which is typical of a workpiece to which the invention has particular applicability.
Figure 3:
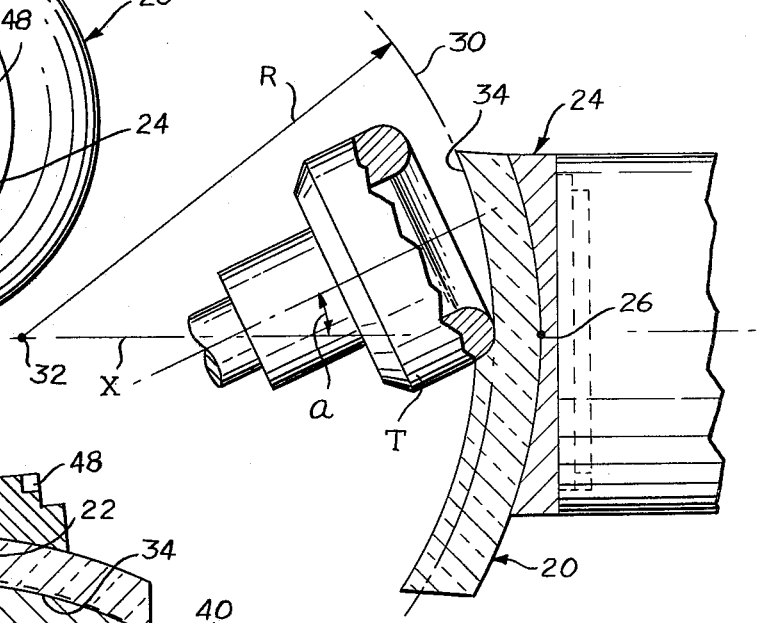
Fig. 3 (PRIOR ART)
FIG. 3 is a partially cross-sectioned diagrammatic illustration of a typical lens surface generating operation following which fine grinding and polishing according to the present invention is required.

Having blocked a particular lens such as lens 20 of FIG. 2 to be surface finished, it is traditionally first rough ground to approximately its desired meniscus configuration, whether spherical or toroidal. Exemplary of such an operation is the arrangement depicted in FIG. 3 wherein blocked lens 20 is supported by block 24 in a machine tool holder 28. Generating of the exposed surface of lens 22 to curvature 30 is then accomplished by swinging a conventional cutting tool T about point 32 at a radial distance R equal to the curvature desired along one meridian, e.g. curvature 30, of lens 20 while the angular disposition (angle *a*) of tool T relative to axis X determines the radius of curvature produced in a second meridian normal to that of curvature 30. This lens generating operation is typical of one commonly used in the art and described in U.S. Pat. No. 2,548,418, for example. While the surface curvature desired for final ophthalmic correction is closely approximated by this operation it is as is well known in the art, attended by eliptical error resulting from the angular presentation of tool T.

Removal of this eliptical error by fine grinding of the resulting generated surface 34 and polishing requires separate surfacing operations to which the present invention is especially directed.

Figure 4:
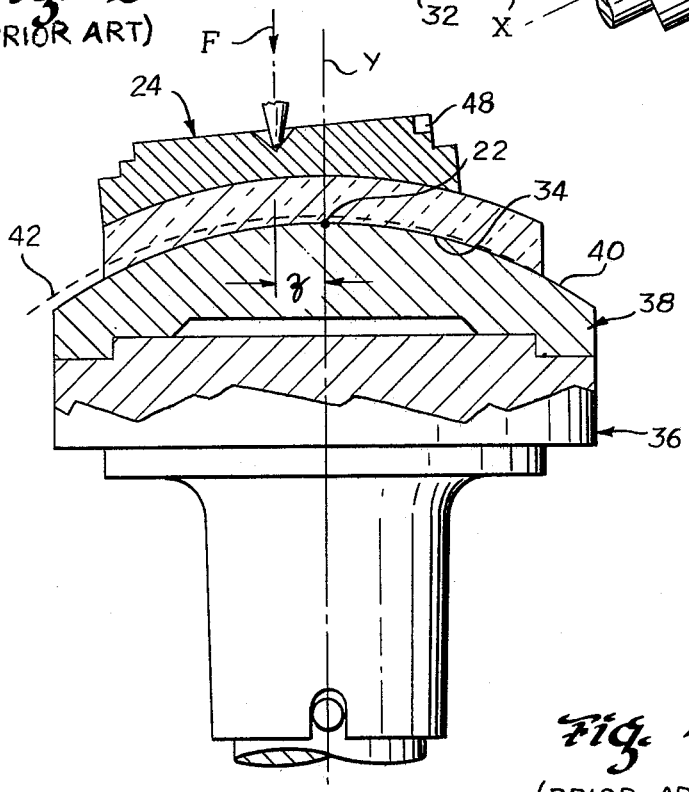
Fig. 4 (PRIOR ART)
FIG. 4 is a fragmentary partially cross-sectional view of an arrangement of blocked lens and tool used in prior art fine grinding and polishing operations and wherewith the present invention, as depicted in subsequent figures of these drawings, can be readily demonstrated and understood.

For a clearer understanding of problems overcome by the present invention the arrangement used heretofore for final lens grinding and polishing is depicted in FIG. 4. A tool holder 36 supports tool (lap) 38 having its surface 40 preformed to precisely the finished shape desired upon surface 34 of lens 20. Tool 38 is engaged by blocked lens 20 substantially as illustrated. Blocked lens 20 is oscillated over surface 40 while an abrasive slurry selected for grinding or a metallic oxide slurry selected for polishing is applied to the lens 20 - tool 38 interface. The operation requires the application of pressure to the lens-tool interface by means of a force F applied to surfacing machine drive pin P and block 24 during movement of lens 20 over tool 38.

As it can be seen in FIG. 4 the force F applied to block 24 is displaced from the geometrical center 22 of lens 20. It is displaced to one side of axis Y of lens 20 by an amount approximately equal to distance *z*. Accordingly the distribution of the pressure resulting from force F over the lens 20 - tool 38 interface is nonuniform. It is greatest beneath block 24 and least at the extreme diametrically opposite side of lens 20.

As illustrated by dot-dash line 42, a greater extent of fine grinding and/or polishing will take place beneath lens block 24 or adjacent the edge of lens 20 nearest thereto while less grinding or polishing action will be effected diametrically oppositely of block 24, i.e. adjacent the right side of lens 20 as it is illustrated in FIG. 4.

In the case of a fine grinding operation wherein a slurry of emery particles or other abrasive means is applied to the lens 20 - tool 38 interface, the resulting greater wearing away of surface 34 beneath lens block 24 which is depicted by line 42 will produce a prism error effect in the final lens product. In similar fashion but with less wearing away of lens surface 34, the use of a metallic oxide polishing medium will produce earlier finishing beneath lens block 24 and tend to leave relatively unfinished portions or "gray" areas beneath the segments of the lens 20 - tool 38 interface which receive less pressure, e.g. adjacent the right hand edge of lens 20 as it is depicted in FIG. 4.

DETAILS OF THE INVENTION

Figure 5:
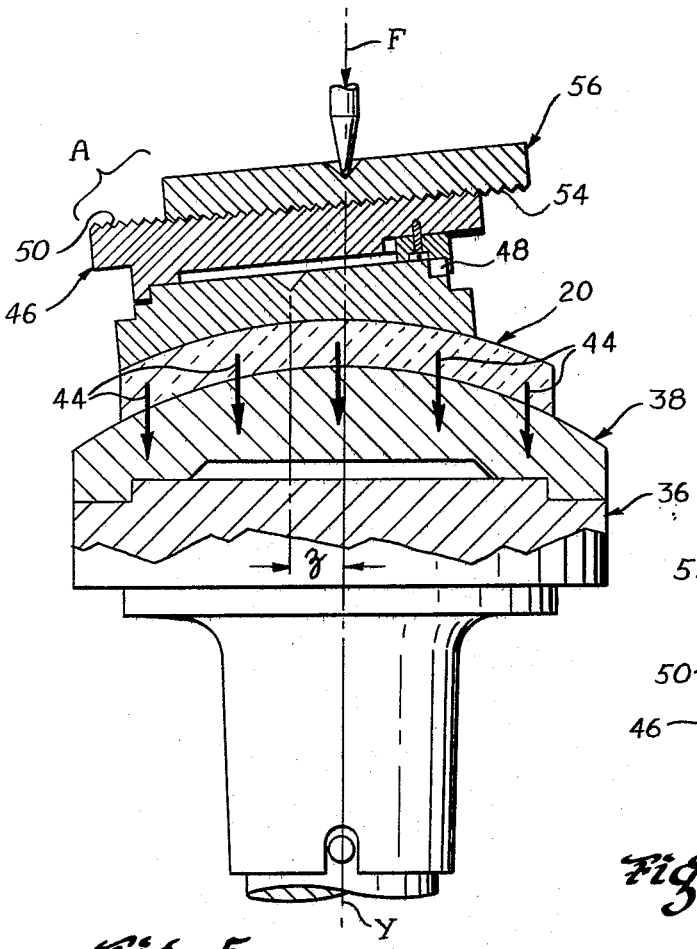
FIG. 5 is a similarly partially cross-sectioned illustration of an arrangement of blocked lens and tool incorporating a preferred embodiment of the invention.

In overcoming the drawbacks of prior art lens fine grinding and polishing operations such as that illustrated in FIG. 4, the invention contemplates an incorporation of a two part lens block adaptor A, FIG. 5. The tool holder, tool or lap, lens and block depicted in FIG. 5 are intended to represent the parts already shown in FIG. 4 and accordingly, are identified by the same reference numerals so that a direct comparison of details of the present invention with the prior art system of FIG. 4 may be made. For example, it can now be seen that a force F applied to adaptor A according to the invention will be directed along axis Y which is the axis of lens 20 rather than to one side thereof as in FIG. 4. Thus, the pressure is applied to the lens 20-tool 38 interface uniformly thereover as depicted by arrows 44 in the FIG. 5 embodiment of the invention. By such means problems of introducing errors of prism and/or unpolished "gray" areas during final surfacing of lens 20 are obviated.

Figure 6:
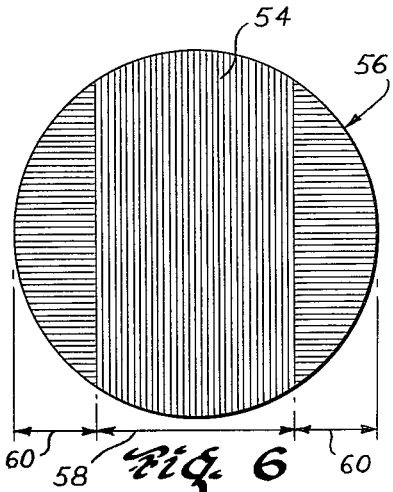
FIGS. 6 & 7 are plan views respectively of the normally interfacially connected surfaces of the lens block adaptor which is illustrated in the arrangement of the FIG. 5 apparatus.
Figure 7:
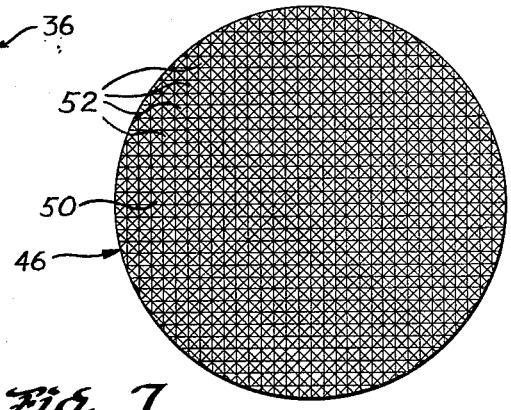

Adaptor A comprises a first member 46 constructed and arranged to intimately fit over lens block 24 and become locked against rotational displacement thereon by keying to tab 48 also shown in FIG. 2. Surface 50 of member 46 is right-angularly knurled to provide a uniform pattern of upwardly directed projections 52 substantially as illustrated in FIG. 7 and against which a surface 54 of the second member 56 of adaptor A is positioned. In order to interlock members 46 and 56 at preselected relative positions of interfacial alignment which brings the center of component 56 coincident with axis Y, and at the same time prevent lateral slippage between members 46 and 56, knurling preferably in the pattern depicted in FIG. 6 is applied to surface 54. This knurling scheme provides for a section 58 which is knurled or ridged in one direction only and remaining sections 60 which are knurled or ridged in another right-angular direction. All knurling or ridging of surface 54 is of such shape and size as to accurately interfit with the right-angular knurling of surface 50 of component 46. As illustrated in the enlarged fragmentary cross-sectional view of FIG. 8, the knurled and/or ridged configuration of surfaces 50 and 54 provide for an interlocking interfacial engagement of components 46 and 56 at any and all preselected overlapping positions thereof. The fineness of knurling and/or ridging is determinative only of the minimum extent of incremental adjustment permitted in any one lateral direction to move one component relative to another from one interlocked position to a next interlocked position.

Figure 8:
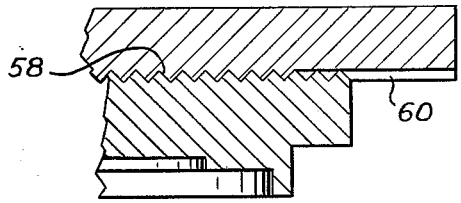
FIG. 8 is an enlarged fragmentary cross-section view of the lens block adaptor.

Referring more particularly to FIG. 8, it can be seen that if surface 54 of component 56 were right angularly knurled exactly as surface 50 of component 46, interfitting of the two surfaces would be possible but slippage in one or both of the right angular directions of knurling would not be prevented. In the present instance of special knurling or ridging used for surface 54, it can be seen from FIG. 8 that the knurling or ridging of sections 60 prevents slippage of one component 46 or 56 relative to the other in directions into and out of the sheet of drawings while knurling or ridging 58 similarly prevents slippage of the aforesaid components in directions left and right across the sheet of drawings.

Figure 9:
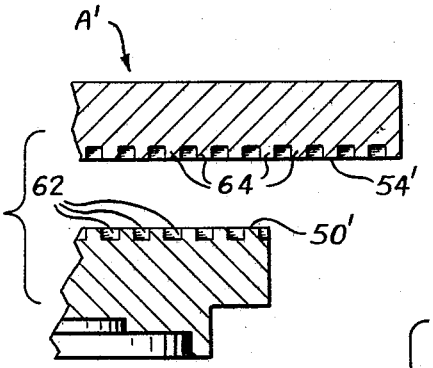
FIGS. 9 and 10 are similar greatly enlarged fragmentary cross-sectional view of modifications of the invention.
Figure 10:
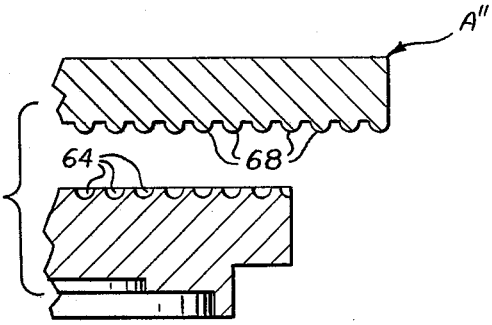

Modifications of the surface treatment illustrated in FIGS. 5 – 8 are illustrated in FIGS. 9 and 10. In FIG. 9, surfaces 50' and 54' are respectively provided with recesses 62 and protrusions 64 which are so correspondingly geometrically patterned as to all simultaneously interfit when the two surfaces 50' and 54' are brought together at a point of adjustment of adaptor A'. By such means lateral slippage is again prevented once adaptor A' is set for use. In similar fashion, semicircular recesses 66 and protrusions 68 may be provided in place of any of the aforesaid schemes as shown in the drawing of adaptor A" (FIG. 10). It should be understood that conical, triangular, rectangular or other variously shaped matching recesses and protrusions may be employed at the discretion of the artisan.

With attention given once again to FIG. 5, it can be seen that the problems of prior art lens fine grinding and polishing which are exemplified in FIG. 4 are overcome by the present invention through provision for shifting the surfacing force from the usual center of a decentered block by an amount *z* sufficient to locate and direct the applied force F along axis Y of the lens so that even distribution of this force over the lens-tool surfacing interface is accomplished as represented by arrows 44.

Those skilled in the art will readily appreciate that there are various other forms and adaptations of the invention which may be made to suit particular requirements. Accordingly, the foregoing illustrations are not to be interpreted as restrictive of the invention beyond that necessitated by the following claims.

I claim:

1. A lens surfacing adaptor for blocked lenses comprising:

a first member on one side having means to detachably fit upon a block used to support a lens for surfacing and an opposite coupling surface;

a second member on one side having means to centrally receive a force required for lens surfacing and an opposite coupling surface;

said coupling surfaces of said first and second members having uniformly geometrically patterned interfitting protrusions and receiving recesses interlocking said members against displacement when said surfaces are brought together and releasable by separation of said surfaces; whereby separation of said first and second members permits selective universal lateral adjustment of one member relative to the other for centering of said second member over the geometrical center of a blocked lens to be surfaced and bringing said members together locks said members in place for applying said surfacing force geometrically centrally against said lens during a surfacing operation.

2. A lens surfacing adaptor according to claim 1 wherein one side of said first member of said adaptor is recessed to receive said block and said one side of said second member is afforded at least one recess for receiving lens surfacing machine drive means through which said force for lens surfacing may be applied to said adaptor.

3. A lens surfacing adaptor according to claim 2 wherein one side of said second member is afforded a single centrally disposed recess for receiving lens surfacing machine drive means normally used for spherical lens surfacing operations.

4. A lens surfacing adaptor according to claim 2 wherein said one side of said second member is afforded at least a pair of diametrically aligned recesses for receiving lens surfacing machine drive means normally used for toric lens surfacing operations.

5. A lens surfacing adaptor according to claim 1 wherein said coupling surface of one of said first and second members is right-angularly knurled and the coupling surface of the other of said members is ridged in directions parallel to one of its diameters over one portion of its extension and similarly ridged right-angularly to said one diameter over remaining portions of its extension.

6. A lens surfacing adaptor according to claim 1 wherein sid coupling surface of one of said first and second members is provided with a uniformly geometrically patterned array of recesses extending from edge-to-edge in all directions thereacross and the coupling surface of the other of said members is provided with an identically uniformly geometrically patterned array of projections each adapted to interfit with a one of said recesses when said coupling surfaces of said first and second members are brought together, said identical geometrical patterning of said arrays of recesses and projections permitting interfitting of said coupling surface at various preselected positions of relative displacement as well as centering.

7. A lens surfacing adaptor according to claim 6 wherein said recesses and projections are of cylindrical configurations.

8. A lens surfacing adaptor according to claim 6 wherein said recesses and projections are of semi-spherical configurations.

9. A lens surfacing adaptor according to claim 6 wherein said recesses and projections are of triangular configurations.

10. A lens surfacing adaptor according to claim 6 wherein said recesses and projections are of rectangular configuration.

* * * * *